US005558418A

United States Patent [19]

Lambright et al.

[11] Patent Number: 5,558,418

[45] Date of Patent: Sep. 24, 1996

[54] FURNITURE ASSEMBLY FOR A COMPACT DESK

[75] Inventors: Michael D. Lambright; Douglas P. Krieger, both of Archbold, Ohio

[73] Assignee: Sauder Woodworking Co., Archbold, Ohio

[21] Appl. No.: 527,832

[22] Filed: Sep. 13, 1995

[51] Int. Cl.[6] ..... E06B 1/00

[52] U.S. Cl. ..... 312/321.5; 312/194; 312/196; 312/223.3; 312/208.1; 248/346.01; 248/346.5; 248/188.1

[58] Field of Search ..... 312/194, 196, 312/223.3, 208.1, 321.5; 248/346.01, 346.5, 188.1

[56] References Cited

U.S. PATENT DOCUMENTS 5,147,127 9/1992 Short ..... 312/321.5

*Primary Examiner*—Peter M. Cuomo

*Assistant Examiner*—Stephen Vu

*Attorney, Agent, or Firm*—Emch, Schaffer, Schaub & Porcello Co., L.P.A.

[57] ABSTRACT

A furniture assembly having first and second side walls in spaced relationship. First and second desk doors are movably mounted between open and closed positions on the first and second side walls, respectively. Each of the first and second desk doors includes an edge wall and a front wall. Each of the first and second desk doors includes integral first and second cart units, respectively. The furniture assembly can also include a hutch assembly.

22 Claims, 10 Drawing Sheets

FURNITURE ASSEMBLY FOR A COMPACT DESK

BACKGROUND OF THE INVENTION

The present invention is directed to a furniture assembly. More specifically, the invention is directed to a furniture assembly in the form of a cabinet having doors, shelves and support surfaces.

It has been found that there is a need for a compact desk that can be used in homes and offices having limited space. The desk should have integral cart units having support surfaces and a drawer. There is also a need for a desk that can be used in combination with a hutch assembly to provide a compact work center. This type of work center should have surfaces for supporting, for example, a computer monitor, a computer keyboard, a computer printer and a computer modem. The work center should also have a plurality of stationary and adjustable shelves for supporting, for example, computer speakers, computer programs and books. The work center should be stable so that one working at the work center would have secure surfaces upon which to work and store items. The work center should be aesthetically pleasing in both the open and closed positions.

The present invention satisfies the above-identified needs. The furniture assembly of the present invention provides a new and useful compact, aesthetically pleasing desk that can be used either alone or in combination with a hutch assembly.

SUMMARY Of THE INVENTION.

The present invention is directed to a furniture assembly. The furniture assembly includes first and second side walls that are in spaced relationship. First and second desk doors are movably mounted between open and closed positions on the first and second side walls, respectively. Each of the first and second desk doors includes an edge wall and a front wall. Each of the first and second desk doors includes an integral cart unit.

The furniture assembly of the present invention can be embodied in a work center having a hutch assembly. The furniture assembly includes first and second side walls that are in spaced relationship. A first plurality of shelves of predetermined depth is positioned between the side walls. The first and second hutch doors are movably mounted between open and closed positions on the first and second side walls, respectively. Each of the first and second hutch doors includes an edge wall, a front wall and a center wall. The center wall extends outwardly from the front wall in spaced relationship to the edge wall. A second plurality of shelves of predetermined depth extends between the edge wall and the center wall outwardly from the front wall. The hutch assembly is positioned above the desk assembly that is described above.

The primary object of the present invention is to provide a compact furniture assembly having a plurality of work and storage surfaces.

It is an important object of the present invention to provide a furniture assembly that is stable.

Other objects and advantages of the present invention will become apparent upon a review of the following detailed description of the preferred embodiments and the accompanying drawings.

DETAILED DESCRIPTION OF THE PREFERRED EMBODIMENTS

Figure 1:
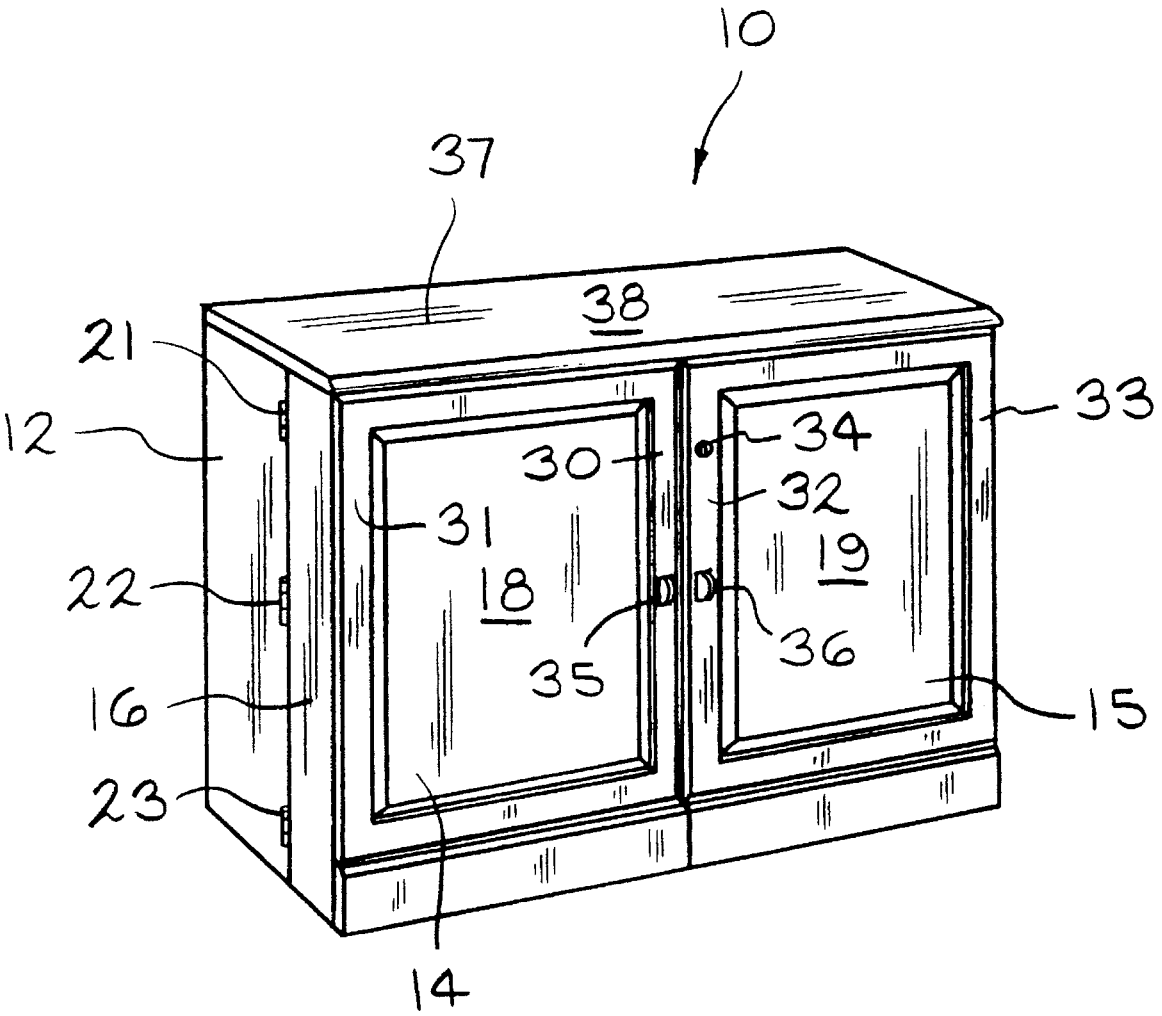
FIG. 1 is perspective view of the first embodiment of furniture assembly of the present invention.
Figure 9:
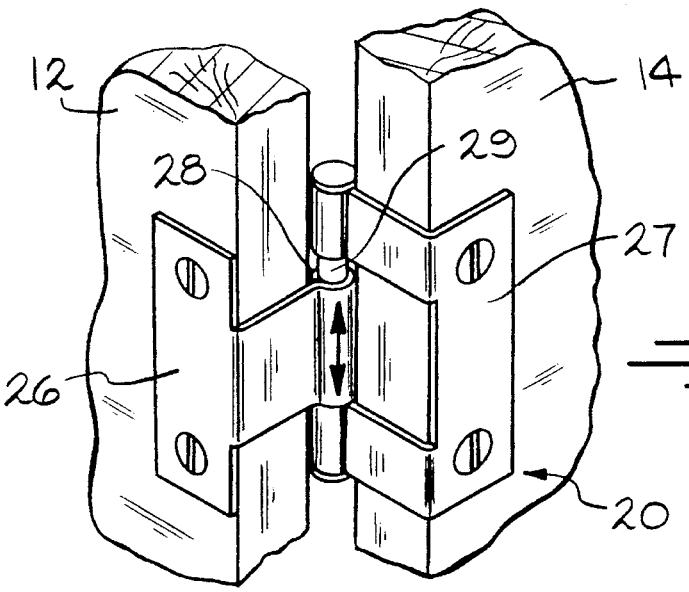
FIG. 9 is a perspective view showing the movable hinge according to the present invention.

The preferred embodiments and best mode of the present invention will now be described in detail with reference being made to the drawings. The first embodiment furniture assembly of the present invention is generally indicated by the reference number 10. The first embodiment is a desk assembly. The furniture assembly 10 as shown in FIG. 1 is in the closed position. Referring to FIGS. 1 to 6, the first embodiment furniture assembly 10 includes a stationary back wall 11. A first side wall 12 and a second side wall 13 extend outwardly from the back wall 11 in spaced relationship. Referring to FIGS. 1, 3 and 4, the furniture assembly 10 includes a first desk door 14 and a second desk door 15. The first and second desk doors 14 and 15 are movably mounted between open and closed positions on the first and second side walls 12 and 13, respectively. The first and second desk doors 14 and 15 include first and second desk edge walls 16 and 17, respectively. The first and second desk doors 14 and 15 include first and second desk front walls 18 and 19, respectively. As shown in FIGS. 3 and 4, the first desk door 14 is movably mounted on the first side wall 12 by at least one hinge. In the preferred embodiment, the first desk door 14 includes three hinges 20, 21 and 22. The second desk door 15 is movably mounted on the second side wall 13 by at least one hinge, and preferably by three hinges 20', 21' and 22'. An example of a hinge that can be used to movably mount the first and second desk doors 14 and 15 to their respective side walls is shown in FIG. 9. The hinge 20 includes a first hinge member 26 that is fixedly attached to, for example, the first side wall 12 and a second hinge member 27 that is fixedly attached to, for example, the first desk door 14. The first hinge member 26 includes a longitudinally extending cavity 28 that receives a longitudinally extending hinge pivot pin 29 that is mounted on the second hinge member 27. The pivot pin 29 is longer than the cavity 28. This allows for longitudinal movement of the pivot pin 29 within the cavity 28 as indicated by the arrow shown in FIG. 9. This arrangement allows the first desk door 14 to be movable up and down within the range defined by the relationship between the cavity 28 and the pivot pin 29. The hinges 20, 21 and 22 attached to the first desk door and the hinges 20', 21' and 22' attached to the second desk door 15 allow the doors to be fully opened even if the furniture assembly 10 is placed on an uneven surface, such as carpeting. The longitudinal movement provided by the hinges allows the doors to lifted upwardly and outwardly so that the edge walls and front walls of the doors can clear the uneven surface.

As shown in FIGS. 1 and 4, the first desk front wall 18 of the first desk door 14 includes a first desk door leading end 30 and a first desk door edge end 31. The second desk front wall 19 of the first desk door 15 includes a second desk door leading end 32 and a second desk edge end 33. As shown in FIG. 1, the first and second desk door leading ends 30 and 32 can include a locking device 34, such as one utilizing a key, to secure the first and second desk doors 14 and 15 in the closed position. The first and second desk door leading ends 30 and 32 can also include knobs 35 and 36, respectively.

Figure 2:
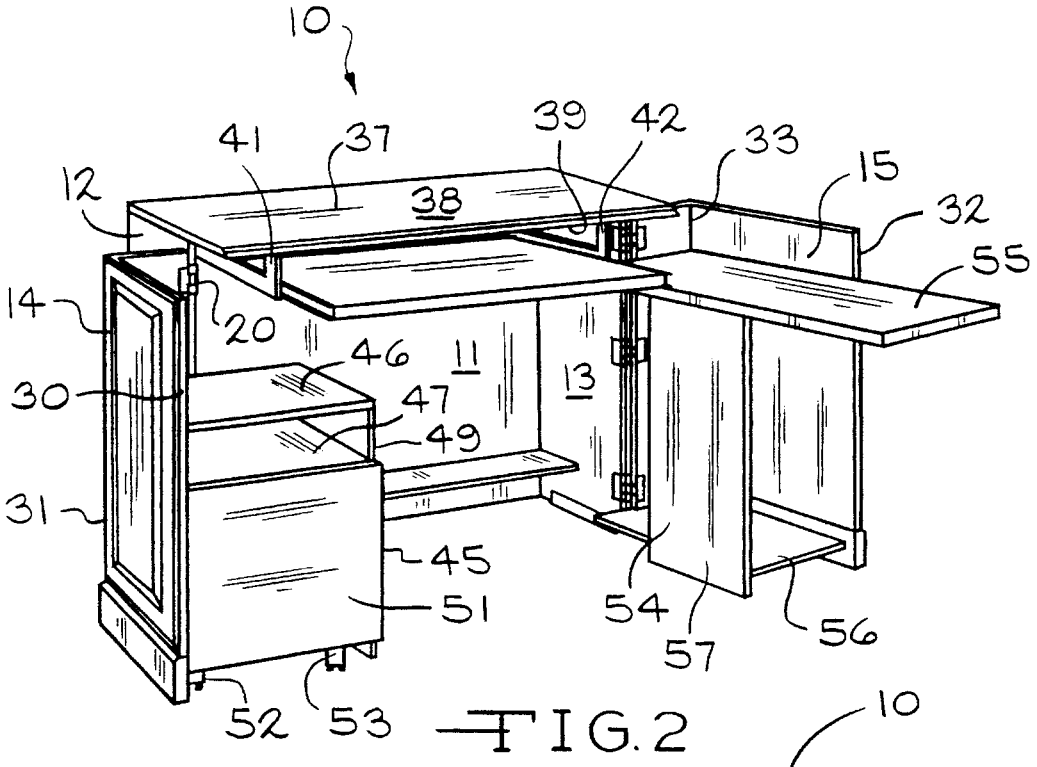
FIG. 2 is a perspective view of the first embodiment of the present invention in an open position.
Figure 3:
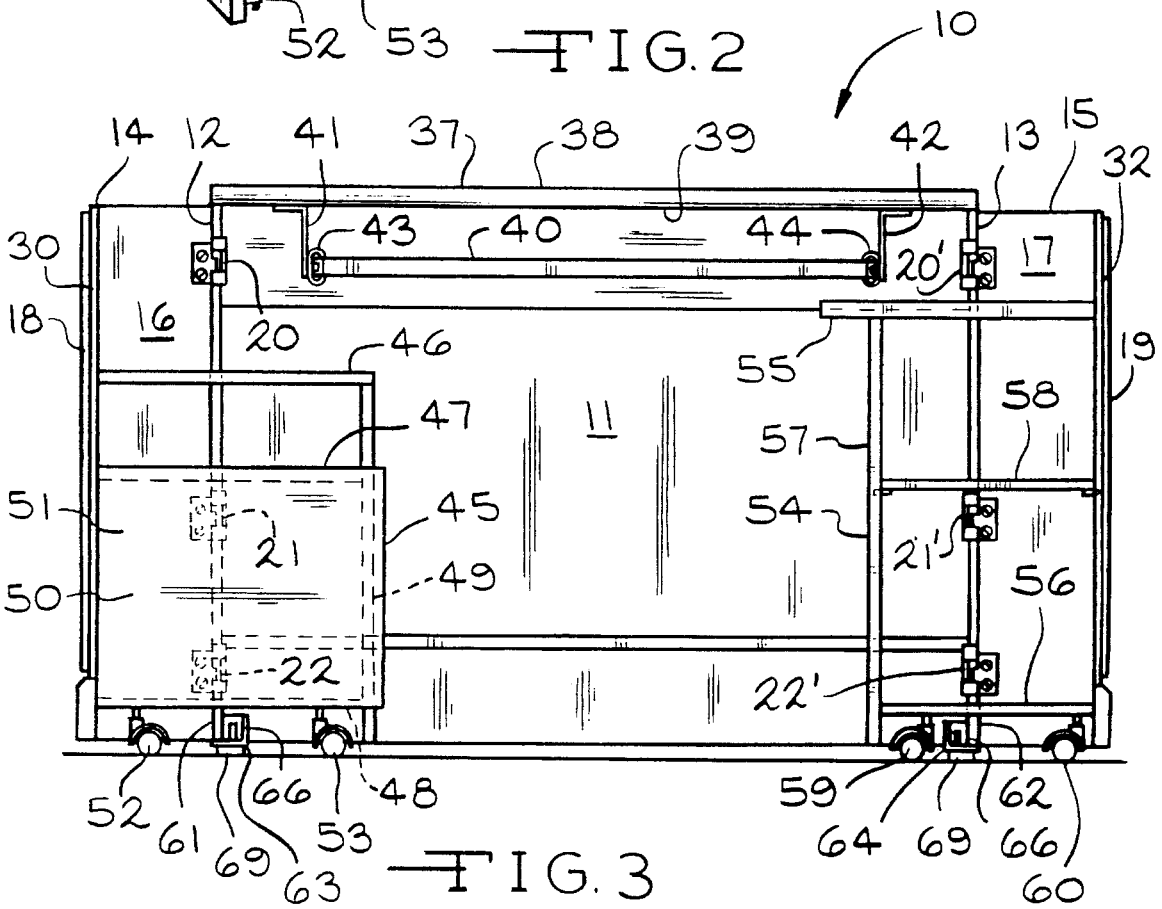
FIG. 3 is a front elevational view of the first embodiment of the present invention in an open position.
Figure 4:
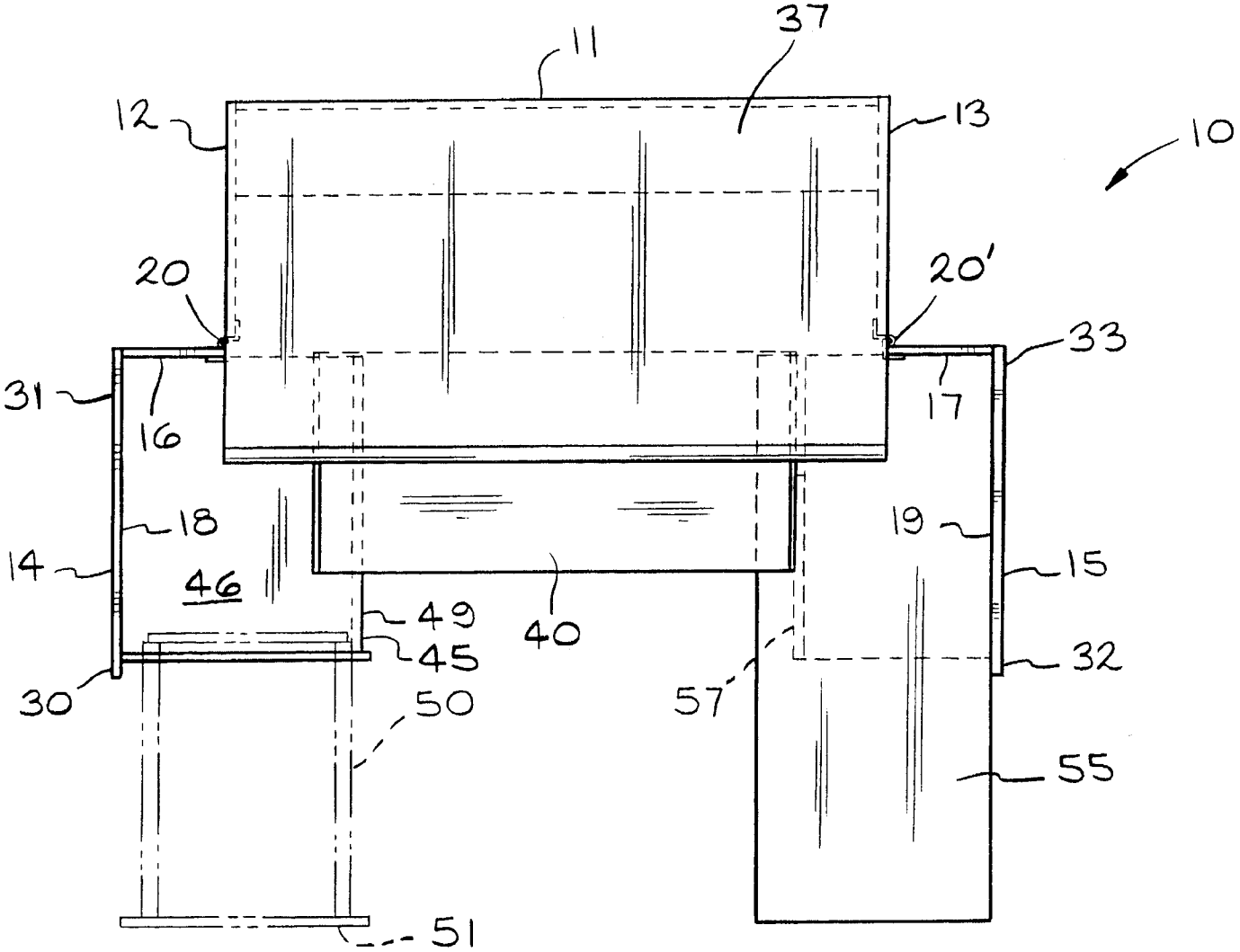
FIG. 4 is a top view of the first embodiment of the present invention in the open position.
Figure 5:
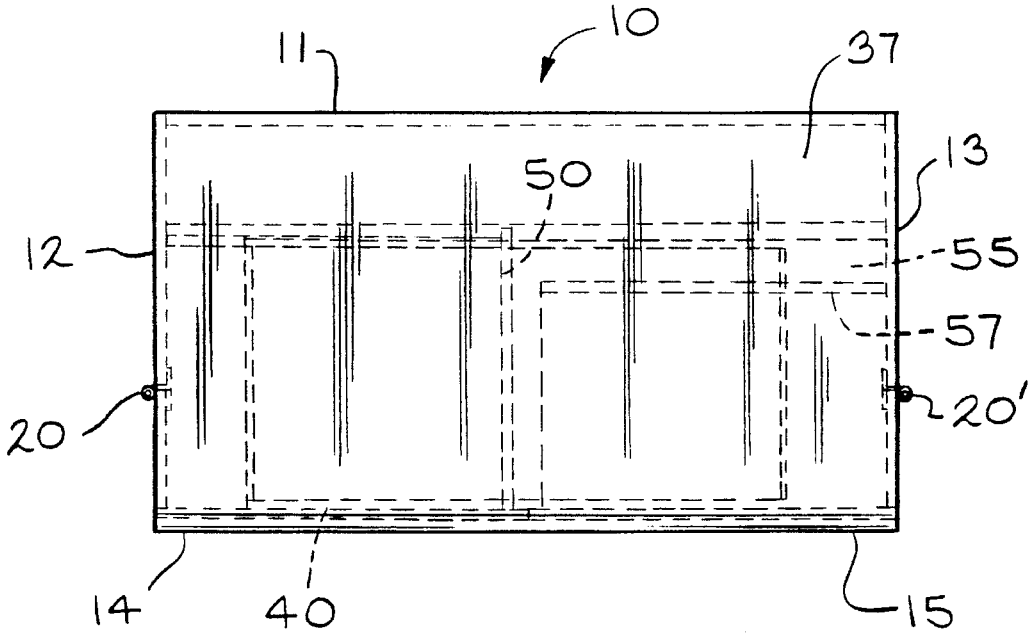
FIG. 5 is a top view of the first embodiment of the present invention in a closed position.
Figure 6:
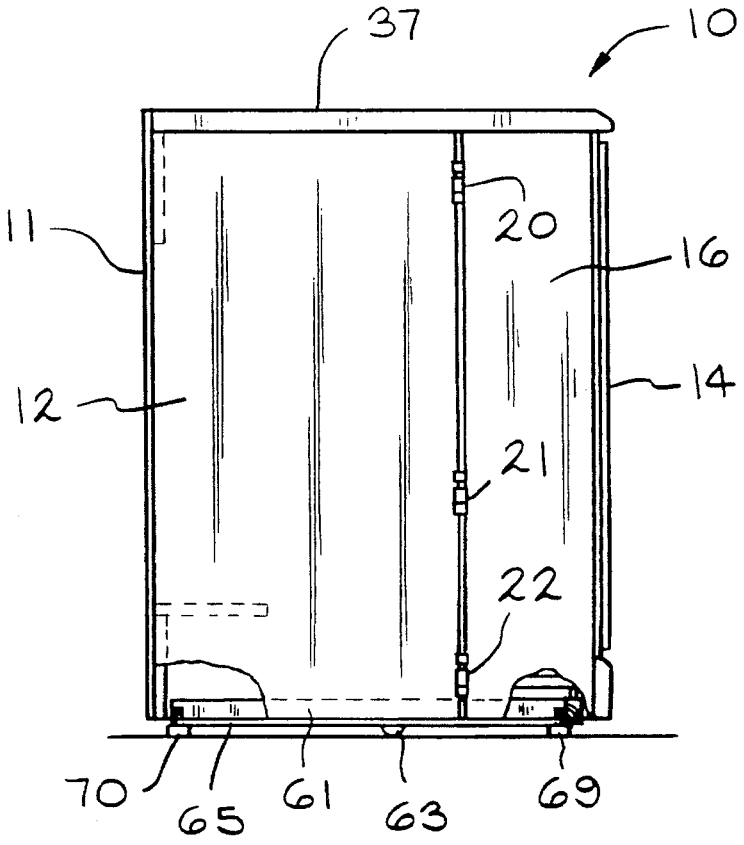
FIG. 6 is a side elevational view of the present invention in the closed position.

Referring to FIGS. 1, 2 and 3, the furniture assembly 10 further includes a support surface 37 extending outwardly from the back wall 11 and positioned between the first and second side walls 12 and 13. The support surface 37 has a top surface 38 and a bottom surface 39. The top surface 38 can support objects or be used as a writing desk. As shown in FIG. 3, a shelf 40 can be slidably mounted on the bottom surface 39 by first and second shelf mounting brackets 41 and 42. The shelf 40 is mounted to brackets 41 and 42 by a first slide 43 and a second slide 44. The shelf 40 can move from a fully extended position as shown in FIGS. 2 and 4 to a retracted position in which the shelf 40 is entirely positioned under the support surface 37 adjacent the bottom surface 39 as shown in FIG. 5. The shelf 40 can support objects.

Referring now to FIGS. 2, 3 and 4, the first desk door 14 includes an integral first cart unit 45. The first cart unit 45 includes at least one first cart top member. In the preferred embodiment, as shown in FIGS. 2 and 3, the first cart unit 45 includes top members 46 and 47 in spaced relationship. Each of the top members 46 and 47 extends outwardly from the first desk edge wall 16 of the first desk door 14. As shown in FIG. 3, the first cart unit 45 further includes a first cart unit bottom member 48 that extends outwardly from the edge wall 16 in spaced relationship with respect to the second top member 47. A first cart unit side member 49 extends between the top members 46 and 47 and the bottom member 48 in spaced relationship with the first desk front wall 18. As shown in FIGS. 2, 3 and 4, a drawer 50 can be positioned between the second top member 47 and the bottom member 48. The drawer 50 includes a front panel 51. As shown in FIG. 3, wheels 52 and 53 can be mounted on the bottom member 48. There can also be two back wheels (not shown). The wheels allow the first cart unit 45 and the first desk door 14 to be easily moved from a closed position to an open position and back again. It should be understood that one or more wheels can be positioned on the bottom member 48, with four wheels being preferred.

As shown in FIGS. 2, 3 and 4, the second desk door 15 of the furniture assembly 10 includes an integral second cart unit 54. The second cart unit 54 includes a second cart unit top member 55 that extends outwardly from the second desk edge wall 17 a predetermined distance to a point beyond the second desk front wall 19. As shown in FIG. 5, the top member 55 is sized so that it can be positioned within the space defined by the first and second desk doors 14 and 15 when the doors are in the closed position. The top member 55 of the second cart unit 54 is positioned on the second desk edge wall 17 and the second desk front wall 19 so that it clears the first top member 46 of the first cart unit 45 when the respective carts are positioned within the closed furniture assembly. A second cart unit bottom member 56 extends outwardly from the second desk edge wall 17 in spaced relationship to the top member 55. A second cart unit side member 57 extends between the top member 55 and the bottom member 56 in spaced relationship to the second desk front wall 19 of the second desk door 15. As shown in FIG. 3, an adjustable shelf 58 can be positioned within this space. As shown in FIG. 3, two front wheels 59 and 60 and two back wheels (not shown) can be mounted on the bottom member 56 to allow the second cart unit 54 and the second desk door 15 to move between open and closed positions. It should be understood that any number of wheels can be mounted on the bottom member 56, with four wheels being preferred.

Figure 7:
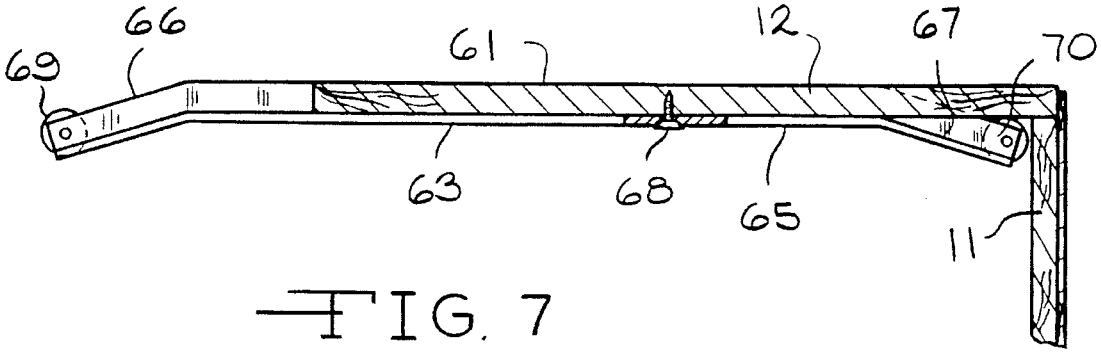
FIG. 7 is a cross-sectional view taken along lines 7—7 of FIG. 8 showing the base portion of the side wall and the stabilizing and leveling base bracket according to the present invention.
Figure 8:
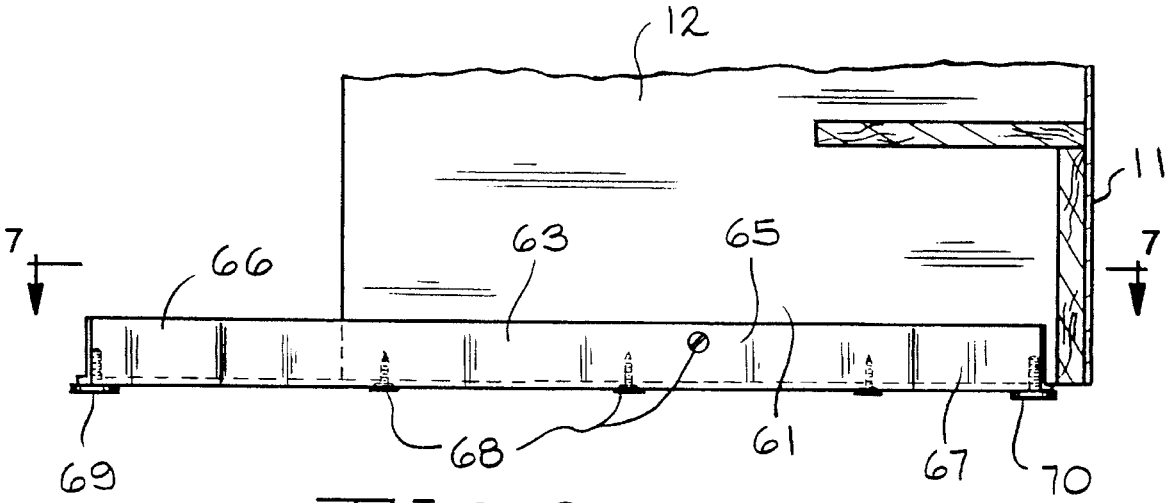
FIG. 8 is a side elevational view of the stabilizing and leveling base bracket according to the present invention.

Referring now to FIGS. 3, 6, 7 and 8, the first and second side walls 12 and 13 include a first base portion 61 and a second base portion 62, respectively. Each of the base portions 61 and 62 extends outwardly from the back wall 11. Stabilizing and leveling base brackets 63 and 64 are attached to the first and second base portions 61 and 62, respectively. As shown in FIGS. 7 and 8, the bracket 63, for example, includes a longitudinally extending body 65, a first end 66 and a second end 67. The bracket 63 extends outwardly from the back wall 11 to a predetermined point beyond the side wall 12 adjacent the first desk edge wall 16 of the first desk door 14. The bracket 63 is attached to the side wall 12 by a plurality of screws 68. The first and second ends 66 and 67 of the body 65 of the bracket 63 each includes first and second pads 69 and 70, respectively. The pads 69 and 70 can be adjusted up and down so that the furniture assembly 10 can be placed in a level position. The brackets 63 and 64 stabilize the furniture assembly 10 so that the assembly does not fall forward when the various doors and drawer are moved to open positions.

Referring to FIGS. 1,2 and 3, the furniture assembly of the present invention can be moved from the closed position as shown in FIG. 1 to the open position as shown in FIG. 2. This is accomplished by grasping knobs 35 and 36 and pulling the first and second desk doors 14 and 15 upwardly and outwardly from underneath the support surface 37. The first and second desk doors 14 and 15 are easily moved because of the previously described hinges and wheels. When the furniture assembly is in the open position, as shown in FIGS. 2 and 3, a knee-hole space is defined by the first cart unit side member 49 and the second cart unit side wall 57. A user of the furniture assembly can position a chair adjacent the knee-hole space and place his or her legs in the space while in a seated position. The user can then work at the furniture assembly. After the user is finished working at the furniture assembly, the first and second desk doors 14 and 15 can be moved from the open position as shown in FIG. 2 to the closed position as shown in FIG. 1. As shown in FIG. 5, the first and second cart units 45 and 54 can be positioned within the closed furniture assembly.

Figure 10:
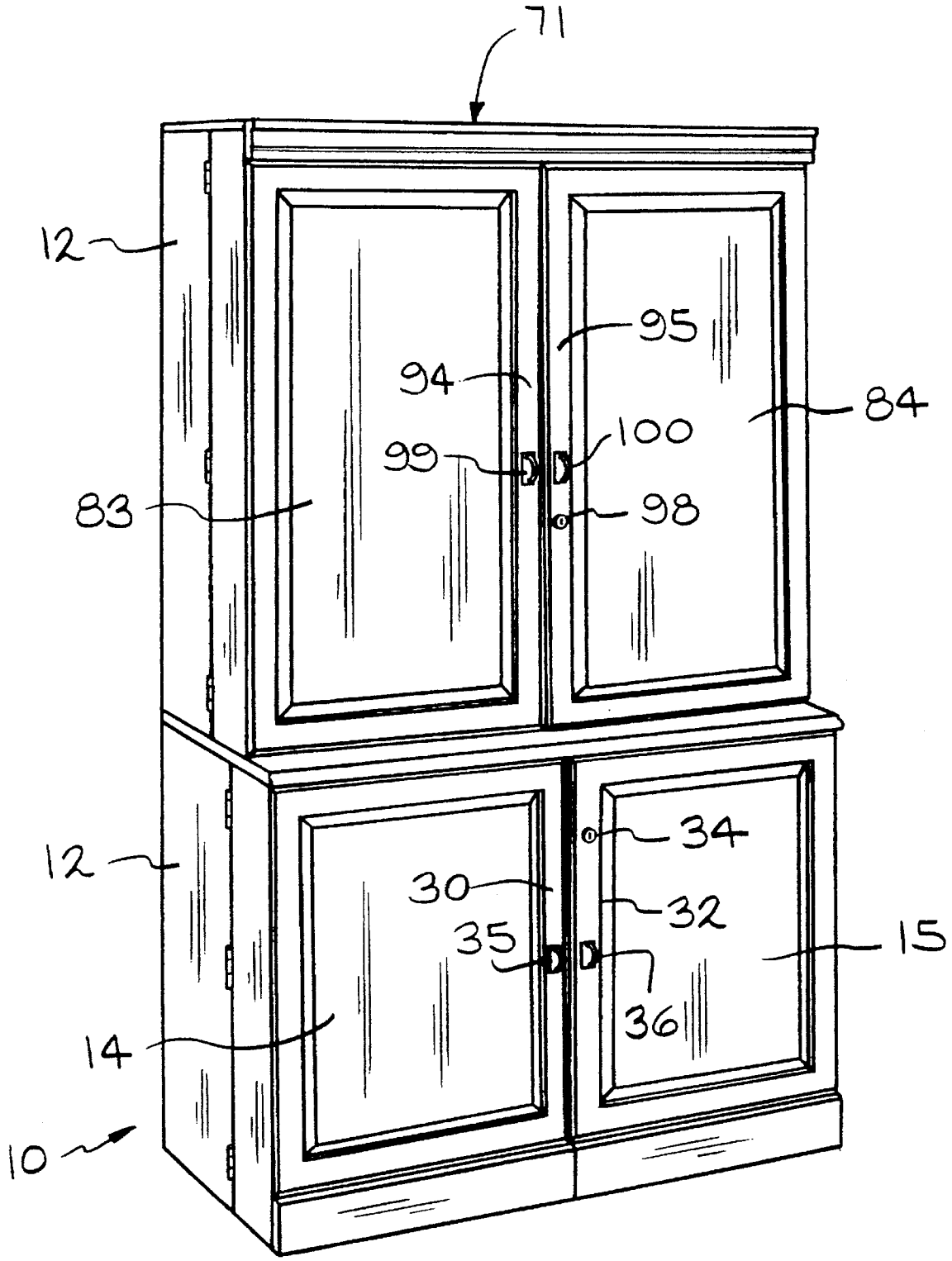
FIG. 10 is a perspective view of a second embodiment of the present invention in a closed position.
Figure 11:
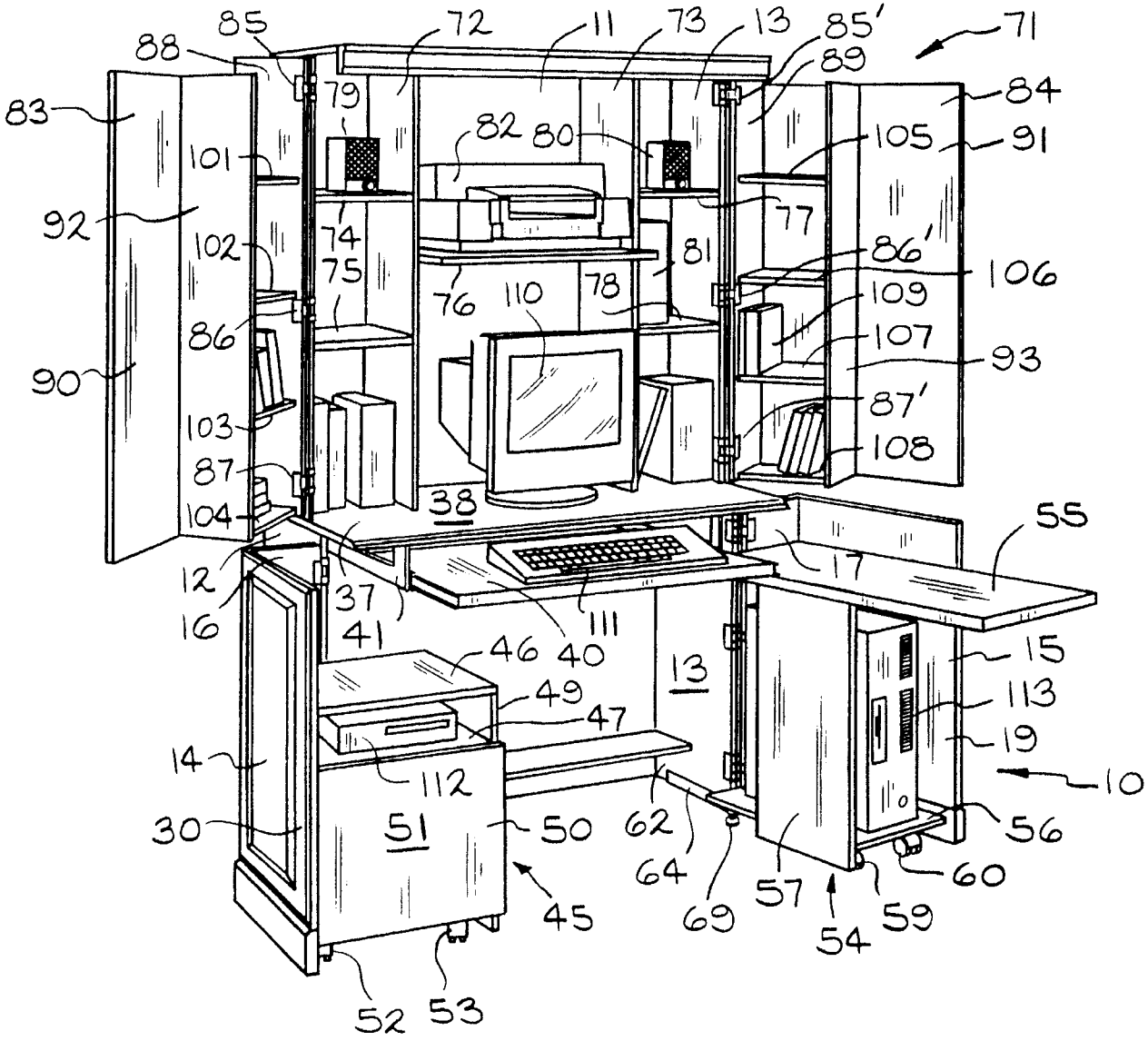
FIG. 11 is a perspective view of the second embodiment of the present invention in an open position showing various objects positioned on the furniture assembly.
Figure 12:
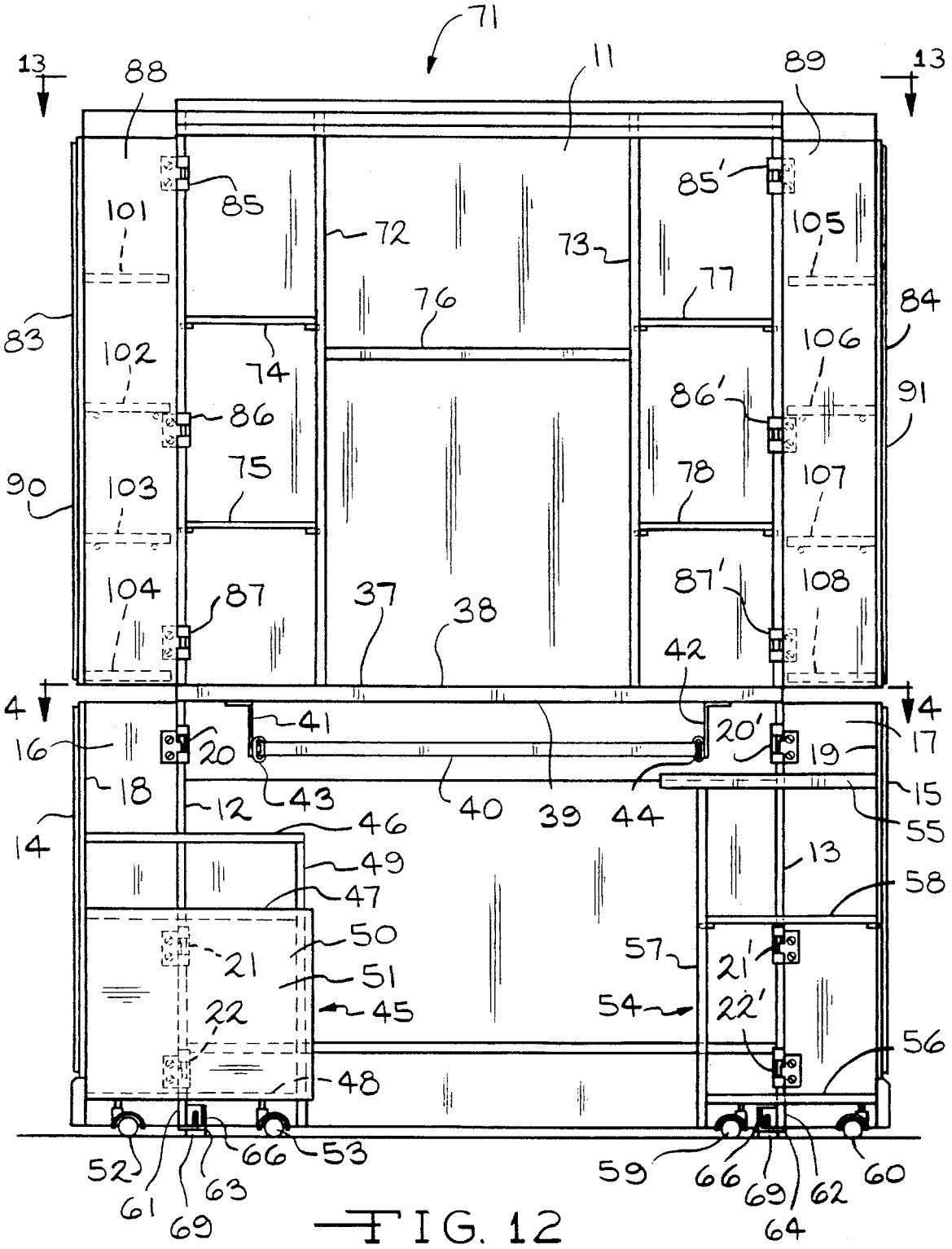
FIG. 12 is a front elevational view of the second embodiment of the present invention in an open position.

The second embodiment of the present invention is shown in FIGS. 10 to 14. In the second embodiment, a hutch assembly 71 is positioned adjacent the top surface 38 of the support surface 37 of the furniture assembly 10. The hutch assembly 71 can be integral with the furniture assembly 10 or it can be a separate unit resting on the support surface 37. In the embodiment shown in FIGS. 10 to 14, the hutch assembly 71 is integral with the furniture assembly 10. Referring to FIGS. 10 to 13, the second embodiment includes a stationary back wall 11. First and second side walls 12 and 13 extend outwardly from the stationary back wall 11 in spaced relationship. A first support wall 72 and a second support wall 73 extend outwardly from the back wall 11 in spaced relationship to one another and to the first and second side walls 12 and 13. A plurality of shelves of predetermined depth is positioned outwardly from the back wall 11 between the first and second side walls 12 and 13. As shown in FIGS. 11 and 12, two shelves 74 and 75 can be positioned between the first side wall 12 and the first support wall 72. One shelf 76 can be positioned between the first and second support wall 72 and 73. Two shelves 77 and 78 can be positioned between the second support wall 73 and the second side wall 13. It should be understood that the hutch assembly 71 of the furniture assembly 10 is not limited to the number of shelves and the positioning of the shelves as shown in the present drawings. The shelves 74 to 78 can be either stationary or adjustable, with adjustable shelves being preferred. As shown in FIG. 11, the shelves 74, 75, 77 and 78 can support objects, such as computer speakers 79 and 80 and a book 81. The shelf 76 can support, for example, a computer printer 82.

Figure 13:
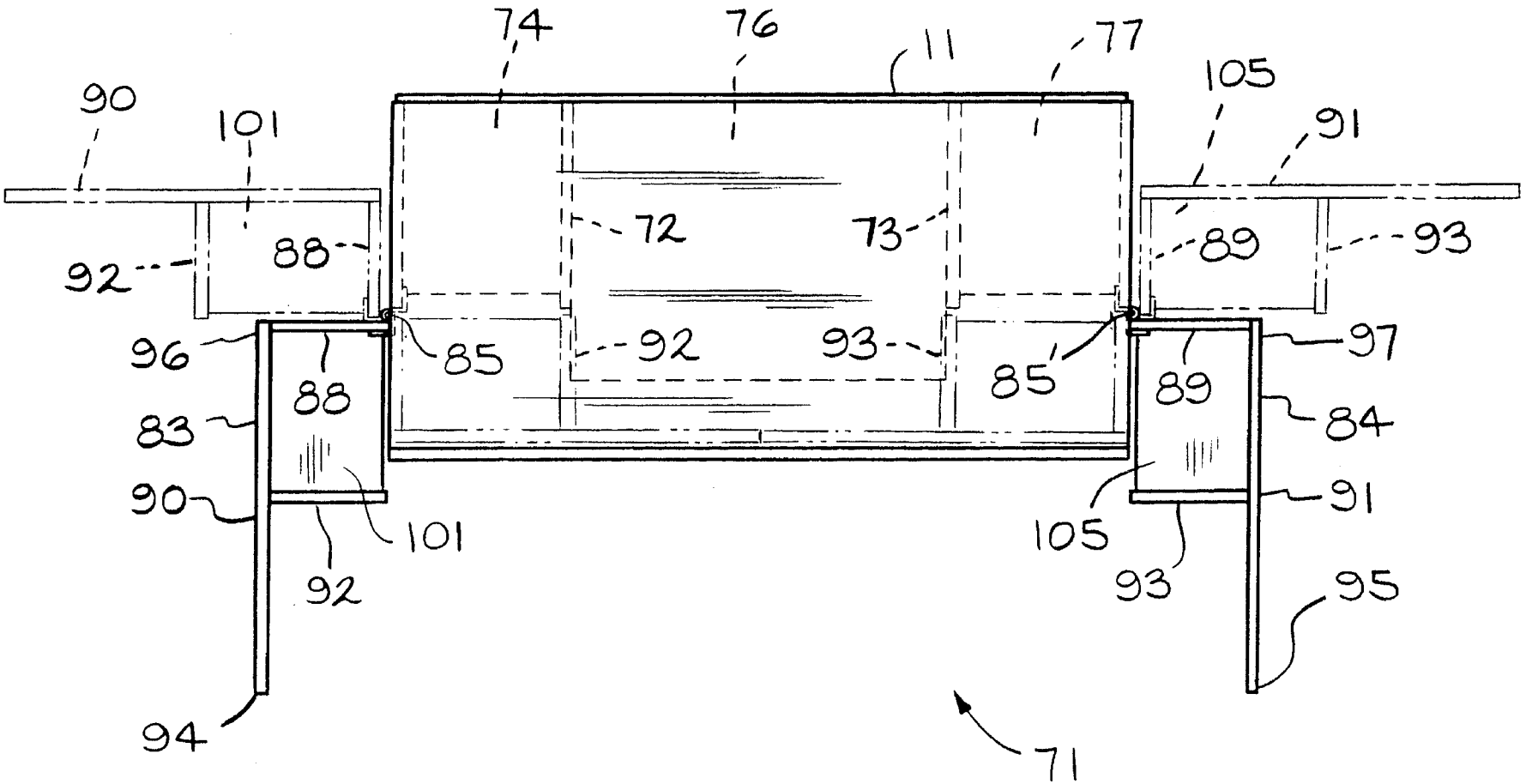
FIG. 13 is a top view of the second embodiment of the present invention showing the hutch assembly in an open position.
Figure 14:
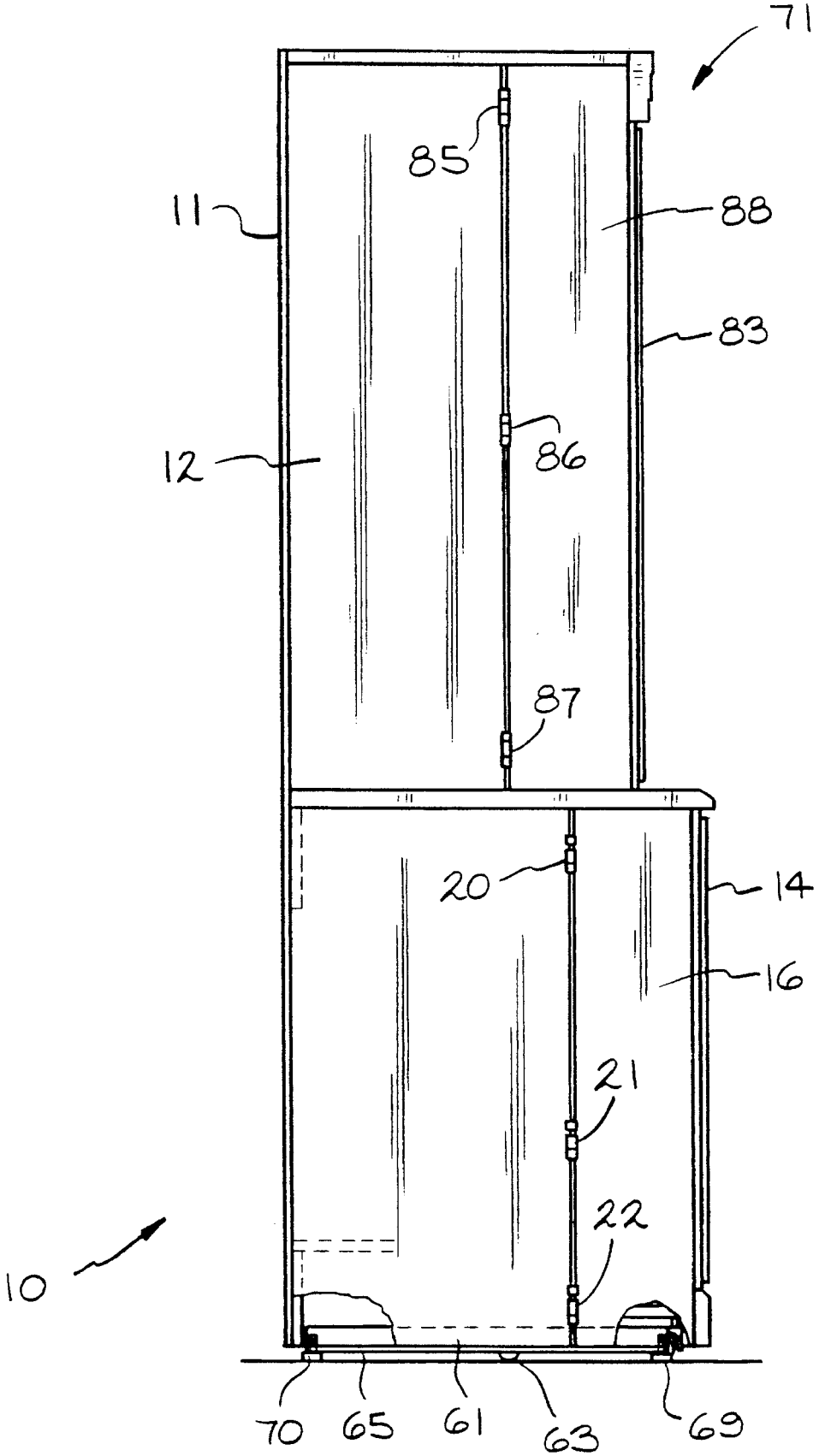
FIG. 14 is a side elevational view of the second embodiment of the present invention in the closed position.

As shown in FIGS. 10 to 13, the hutch assembly 71 includes first and second hutch doors 83 and 84. The first and second hutch doors 83 and 84 are movably mounted between open and closed positions on the first and second side walls 12 and 13, respectively. The closed position of the first and second hutch doors 83 and 84 is shown in FIG. 10. The open position of the first and second hutch doors 83 and 84 is shown in FIG. 11. As shown in FIG. 13, the first and second hutch doors 83 and 84 can be moved in a variety of open positions. The first and second hutch doors 83 and 84 are each movably mounted on the first and second side walls 12 and 13, respectively, by at least one hinge. As shown in FIG. 12, three hinges 85, 86 and 87 are used to mount the first hutch door 83 on the first side wall 12. Three hinges 85', 86' and 87' are used to mount the second hutch door 84 on the second side wall 13.

As shown in FIGS. 12 and 13, the first and second hutch doors 83 and 84 each includes first and second hutch door edge walls 88 and 89, respectively, first and second hutch door front walls 90 and 91, respectively, and first and second hutch door center walls 92 and 93, respectively. Referring to FIG. 13, the edge walls 88 and 89 are adjacent the hinges. The edge walls 88 and 89 are in perpendicular relationship with respect to their respective front walls 90 and 91. The center walls 92 and 93 extend outwardly from their respective front walls 90 and 91 in spaced relationship to the edge walls 88 and 89, respectively. Referring still to FIG. 13, the front walls 90 and 91 include a first hutch door leading end 94 and a second hutch door leading end 95, respectively, and a first hutch door edge end 96 and a second hutch door edge end 97, respectively. The center walls 92 and 93 are positioned equidistant between their respective leading ends 94 and 95 and edge ends 96 and 97. When the first and second hutch doors 83 and 84 are in the closed position, the center walls 92 and 93 are adjacent the first and second support walls 72 and 73, respectively. As shown in FIG. 13, the first and second center walls 92 and 93 and the first and second hutch leading ends 94 and 95 are in spaced relationship. When the first and second hutch doors 83 and 84 are in the closed position, the shelf 76 is received in the space defined by the center walls and the leading ends. As shown in FIG. 10, the first and second hutch leading ends 94 and 95 can include a locking device 98, such as one utilizing a key, to secure the first and second hutch doors 83 and 84 in the closed position. The first and second hutch leading ends 94 and 95 can also include knobs 99 and 100, respectively, for opening and closing the hutch doors.

Referring to FIGS. 11, 12 and 13, the first hutch door 83 includes four shelves 101,102, 103 and 104. Each of the shelves 101,102, 103 and 104 has a predetermined depth and extends between the first hutch edge wall 88 and the first hutch center wall 92 outwardly from the first hutch front wall 90. The second hutch door 84 includes four shelves, 105, 106, 107 and 108. Each of the shelves 105, 106, 107 and 108 has a predetermined depth and extends between the second hutch edge wall 89 and the second hutch center wall 93 outwardly from the second hutch front wall 91. It should be understood that both the first hutch door 83 and the second hutch door 84 can include various numbers of shelves with four shelves each being preferred. The shelves of the first and second hutch doors 83 and 84 can be either stationary or adjustable, with stationary shelves being preferred. As shown in FIG. 11, objects such as a book 109 can be positioned on the shelves.

As shown in FIG. 11, a computer monitor 110 can be positioned on the top surface 38 of the support surface 37. A computer keyboard 111 can be positioned on the shelf 40. A computer modem 112 can be positioned on the second top member 47 of the first cart unit 45. A computer CPU 113 can be positioned on the bottom member 56 of the second cart unit 54.

The present invention can be a ready-to-assemble (RTA) product. RTA products consist of components manufactured and packaged in an unassembled condition. The components are then assembled by the ultimate consumer. The components of RTA products usually consist of composite or particle board having a laminated exterior surface. The exterior surface can include a variety of designs and colors. For example, the exterior surface can include a stained woodgrain pattern. The embodiments of the invention shown in FIGS. 1 and 10 have a traditional, raised panel design. The furniture assembly of the present invention can also have transitional and contemporary designs. The RTA furniture components are joined together with various fastening devices, such as screws and brackets.

Various modifications of the above-described embodiments of the present invention can be made without departing from the scope of the following claims.

We claim:

1. A furniture assembly for a compact desk comprising:

first and second side walls extending outwardly from a back wall in spaced relationship, said first and second side walls including first and second base portions, respectively;

a support surface extending between said first and second side walls, said support surface having a top surface and a bottom surface;

first and second desk doors each having an edge wall and a front wall, each of said edge walls being directly mounted on said first and second side walls by hinge means to allow said first and second doors to be movable between open and closed positions, each of said first and second desk doors including integral first and second cart units, respectively; and first and second base brackets mounted on said first and second base portions, respectively, said brackets including bodies extending outwardly from said back wall along said base portions to predetermined points beyond said side walls adjacent said edge walls of said desk doors.

2. The furniture assembly of claim 1, wherein said first cart unit includes at least one first cart unit top member and a first cart unit bottom member extending outwardly from said edge wall of said first desk door in spaced relationship, a drawer positioned between said first cart unit top and bottom members, and wheel means mounted adjacent said first cart unit bottom member.

3. The furniture assembly of claim 1, wherein said second cart unit includes at least one second cart unit top member and a second cart unit bottom member extending outwardly from said edge wall of said second desk door in spaced relationship, and wheel means mounted adjacent said second cart unit bottom member.

4. The furniture assembly of claim 1, wherein a shelf is slidably mounted directly on the bottom surface of said support surface.

5. The furniture assembly of claim 1, wherein each of said front walls of said first and second desk doors includes a leading end, at least one of said leading ends includes locking means to secure said first and second desk doors in said closed position.

6. The furniture assembly of claim 1, wherein said hinge means is at least one hinge attached to each of said edge walls of said first and second doors and each of said first and second side walls respectively, said hinges being longitudinally movable from a first position to a second position, whereby said first and second desk doors are each vertically movable with respect to said first and second side walls, respectively.

7. The furniture assembly of claim 1, wherein each of said bracket bodies includes a first end and a second end, at least one adjustable pad positioned adjacent each of said first and second ends.

8. A furniture assembly for a compact desk and hutch comprising:

first and second side walls extending outwardly from a back wall in spaced relationship, said first and second side walls including first and second base portions, a first plurality of shelves of predetermined depth positioned between said side walls;

a support surface extending between said first and second side walls, said support surface having a top surface and a bottom surface;

first and second hutch doors movably mounted between open and closed positions on said first and second side walls, respectively, each of said first and second hutch doors including an edge wall, a front wall and a center wall, said center wall extending outwardly from said front wall in spaced relationship to said edge wall, a second plurality of shelves of predetermined depth extending between said edge wall and said center wall outwardly from said front wall; and first and second desk doors each having an edge wall and a front wall, each of said edge walls being directly mounted on said first and second side walls by hinge means to allow said first and second desk doors to be movable between open and closed positions, said first and second desk doors including integral first and second cart units, respectively; and first and second base brackets mounted on said first and second base portions, respectively, said brackets including bodies extending outwardly from said back wall along said base portions to predetermined points beyond said side walls adjacent said edge walls of said desk doors.

9. The furniture assembly of claim 8, wherein said first cart unit includes at least one first cart unit top member and a first cart unit bottom member extending outwardly from said edge wall of said first desk door in spaced relationship, a drawer positioned between said first cart unit top and bottom members, and wheel means mounted adjacent said first cart unit bottom member.

10. The furniture assembly of claim 8, wherein said second cart unit includes at least one second cart unit top member and a second cart unit bottom member extending outwardly from said edge wall of said second door in spaced relationship, and wheel means mounted adjacent said second cart unit bottom member.

11. The furniture assembly of claim 8, wherein said furniture assembly further includes first and second support walls in spaced relationship to one another and to said first and second side walls.

12. The furniture assembly of claim 11, wherein said first plurality of shelves includes at least one shelf positioned between said first side wall and said first support wall, at least one shelf positioned between said first and second support walls, and at least one shelf positioned between said second support wall and said second side wall.

13. The furniture assembly of claim 11, wherein each of said center walls of said first and second hutch doors is adjacent said first and second support walls, respectively, when said first and second hutch doors are in said closed position.

14. The furniture assembly of claim 8, wherein a shelf is slidably mounted directly on the bottom surface of said support surface.

15. The furniture assembly of claim 8, wherein each of said first and second hutch doors is movably mounted on said first and second side walls, respectively, by at least one hinge means.

16. The furniture assembly of claim 8, wherein each of said front walls of said first and second hutch doors and first and second desk doors includes a leading end and an edge end.

17. The furniture assembly of claim 16, wherein each of said center walls of said first and second hutch doors is positioned substantially equidistant between said leading end and said edge end.

18. The furniture assembly of claim 17, wherein each of said center walls and said leading ends of said first and second hutch doors being in spaced relationship, at least one shelf of predetermined depth extending between said side walls being received between said center walls and said leading ends when said first and second hutch doors are in said closed position.

19. The furniture assembly of claim 16, wherein at least one of said leading ends of said first and second hutch doors includes locking means to secure said first and second hutch doors in said closed position.

20. The furniture assembly of claim 16, wherein at least one of said leading ends of said first and second desk doors includes locking means to secure said first and second desk doors in said closed position.

21. The furniture assembly of claim 8, wherein said hinge means is at least one hinge attached to each of said edge walls of said first and second doors and each of said first and second side walls respectively, said hinges being longitudinally movable from a first position to a second position, whereby said first and second desk doors are each vertically movable with respect to said first and second side walls, respectively.

22. The furniture assembly of claim 8, wherein each of said bracket bodies includes a first end and a second end, at least one adjustable pad positioned adjacent each of said first and second ends.

* * * * *